US007219681B1

(12) United States Patent
Hamilton-Jones

(10) Patent No.: US 7,219,681 B1
(45) Date of Patent: May 22, 2007

(54) CANOPY TENSION ADJUSTER

(75) Inventor: Matthew H. Hamilton-Jones, Endwell, NY (US)

(73) Assignee: Johnson Outdoors Inc., Racine, WI (US)

( * ) Notice: Subject to any disclaimer, the term of this patent is extended or adjusted under 35 U.S.C. 154(b) by 0 days.

(21) Appl. No.: 10/292,220

(22) Filed: Nov. 12, 2002

Related U.S. Application Data

(60) Provisional application No. 60/338,019, filed on Nov. 13, 2001.

(51) Int. Cl.
*E04H 15/34* (2006.01)

(52) U.S. Cl. ..... 135/123; 135/119; 135/907; 403/83; 403/169

(58) Field of Classification Search ..... 135/123, 135/124, 125, 126, 128, 121, 120.1, 119, 135/135, 905, 907; 403/83, 84, 85, 89, 169, 403/170, 171, 176, 217, 218, 187, 188, 192; 296/100.15
See application file for complete search history.

(56) References Cited

U.S. PATENT DOCUMENTS 992,383 A * 5/1911 Paul ..... 135/153
1,449,894 A 3/1923 Dial
1,502,898 A 7/1924 Berg
1,631,215 A * 6/1927 Leffert ..... 135/98
1,820,002 A * 8/1931 Forrester ..... 135/140
2,151,908 A * 3/1939 Gottlieb ..... 135/136
2,185,629 A * 1/1940 Dixon ..... 135/153
2,197,791 A 4/1940 Eddy
2,232,306 A * 2/1941 Baldwin ..... 135/139
2,530,765 A * 11/1950 Greenup ..... 135/98
2,551,277 A * 5/1951 Mergentheim, Jr. ..... 135/33.5
2,555,220 A * 5/1951 Brown ..... 135/139
2,723,673 A * 11/1955 Call ..... 135/140
2,811,164 A 10/1957 Ames
2,889,838 A 6/1959 Aviezer et al.
3,119,402 A * 1/1964 Bleick ..... 135/142
3,367,348 A * 2/1968 Kirkham ..... 135/140
3,424,178 A * 1/1969 Yazaki ..... 135/157
3,499,457 A * 3/1970 Brohn et al. ..... 135/123
3,621,857 A * 11/1971 May et al. ..... 135/94
4,948,289 A * 8/1990 Dellinger ..... 403/246
5,167,246 A * 12/1992 Mortenson ..... 135/153
5,335,685 A 8/1994 Dahulich
5,797,411 A * 8/1998 Parker ..... 135/136
6,200,060 B1 3/2001 Vernay
6,234,561 B1 * 5/2001 Huotari ..... 296/100.15
6,353,969 B1 * 3/2002 LeMole ..... 16/352
6,591,849 B1 * 7/2003 Swetish et al. ..... 135/140
6,772,780 B2 * 8/2004 Price ..... 135/131

* cited by examiner

*Primary Examiner*—Anita M. King
(74) *Attorney, Agent, or Firm*—Reinhart Boerner Van Deuren P.C.

(57) ABSTRACT

A tent that includes a swivel portion is disclosed. The tent includes a canopy, a plurality of tent frame components and a swivel portion coupled to at least one of the tent frame components and the canopy. The swivel portion pivots between a relaxed position in which the canopy is in a relaxed state and a tensioned position in which the canopy is in a tensioned state.

24 Claims, 5 Drawing Sheets

CANOPY TENSION ADJUSTER

CROSS-REFERENCE TO RELATED APPLICATIONS

The present invention claims priority from U.S. Provisional Patent Application No. 60/338,019 titled "Canopy Tension Adjuster" filed Nov. 13, 2001, the full disclosure of which is hereby incorporated herein by reference.

FIELD OF THE INVENTION

The present invention generally relates to portable shelters, known as tents, having a roof provided by at least one canopy. In particular, the present invention relates to mechanisms for placing the flexible covering material of the canopy in tension and for connecting the flexible material to a frame or other supporting structure of the tent.

BACKGROUND OF THE INVENTION

It is generally known to provide for standard commercial tent brackets used for tent frame assembly that do not swivel. FIGS. 1 and 2 illustrate a conventionally known portable shelter 110. FIG. 1 is an assembled shelter tent while FIG. 2 is a exploded perspective view of shelter 110. As shown by FIGS. 1 and 2, shelter 110 is generally assembled by utilizing four corner brackets 132 to join support poles 126 and cross poles 128. Cables 138 are connected to the poles so as to cross one another at a midpoint. Fabric top 130 is further secured to the stationary pins 112 of corner brackets 132. Connecting fabric top 130 to pins 112 of corner brackets 132 generally requires either a special pry tool configured to pry and stretch the fabric top over and onto each of pins 112 or requires four people simultaneously pulling on fabric top 130 so as to position the loops at the corners of fabric top 130 over and onto each of pins 112. Poke-up rod 142 and pulley bar 140 are then mounted to the midpoint or intersection of cables 138 and connected to the apex of top 130 to poke up the center of fabric top 130. Once top 130 is on the frame provided by poles 128, 126 and corner brackets 132, ratchet assemblies 136 raise the canopy provided by fabric top 130.

However, such commercial tent brackets have many disadvantages. Although commonly employed, such portable shelters are difficult and time consuming to set up. Stretching fabric top 130 to place fabric top 130 in tension as it is connected to corner bracket 132 is tedious, time consuming and requires multiple person crews. Moreover, specialized tools such as canopy jacks and pry bars are usually required for raising the tent as well. Thus, there is a continuing need for a portable shelter that is easier and less time consuming to set up and requires fewer persons for set up.

Accordingly, it would be advantageous to provide a canopy tension adjuster that requires less time for assembly of tent canopies and cuts the need for extra tools and canopy jacks. It would also be advantageous to provide a canopy tension adjuster that swivels and thereby eliminates the need for extra people to assemble the tent frame and attach the top. It would be desirable to provide for a canopy tension adjuster having one or more of these or other advantageous features.

SUMMARY OF THE INVENTION

A primary feature of the present invention is to provide an inexpensive, easy-to-manufacture, and aesthetically pleasing canopy tension adjuster that overcomes the above-noted disadvantages.

Another feature of the present invention is to provide a canopy tension adjuster that is reliable, is of relatively simple construction, and is relatively simple to install and adjust or reconfigure.

Another feature of the present invention is to provide a canopy tension adjuster that enables a canopy to be quickly and easily connected to an underlying frame and to be placed in a taut or tensioned state. Also, it is a feature of the present invention to provide a canopy tension adjuster that eliminates the need for special pry bar tools or large setup crews. As a result, such portable shelters and tents may be manufactured, set up and taken down at a lower cost.

These and other advantages and features of the present invention may also be accomplished in a canopy tension adjuster configured for use in wide variety of commercial, non-commercial, and recreational uses and settings.

How these and other advantages and features of the present invention are accomplished (individually, collectively, or in various subcombinations) will be described in the following detailed description of the preferred and other exemplary embodiments, taken in conjunction with the FIGURES. Generally, however, they are accomplished in a tension adjuster for use with a frame and covering. The tension adjuster comprises a first portion adapted to be coupled to one of the frame and the covering. The tension adjuster further comprises a second portion pivotally coupled to the first portion and adapted to be coupled to the other of the frame and the covering. The second portion pivots relative to the first portion between a relaxed position in which the canopy is in a relaxed state and a tensioned position in which the canopy is in a tensioned state.

According to another exemplary embodiment of the present invention, a tent is provided that includes a canopy, a plurality of tent frame components and a swivel portion coupled to at least one of the tent frame components and the canopy. Furthermore, the swivel portion pivots between a relaxed position in which the canopy is in a relaxed state and a tensioned position in which the canopy is in a tensioned state.

According to yet another exemplary embodiment of the present invention, a method for erecting a tent is provided. The method includes providing a plurality of space support poles, providing a swivel portion pivotally coupled to at least one of the plurality of support poles, coupling a canopy to the swivel portion while the swivel portion is in a relaxed position and while the canopy is in a relaxed state such that the canopy extends between the plurality of support poles, pivoting the swivel portion to a tensioned position such that the canopy is in a tensioned state, and releasably retaining the swivel portion in the tensioned position.

The present invention further relates to various features and combinations of features shown and described in the disclosed embodiments. Other ways in which the objects and features of the disclosed embodiments are accomplished will be described in the following specification or will become apparent to those skilled in the art after they have read this specification. Such other ways are deemed to fall within the scope of the disclosed embodiments if they fall within the scope of the claims which follow.

Figure 1:
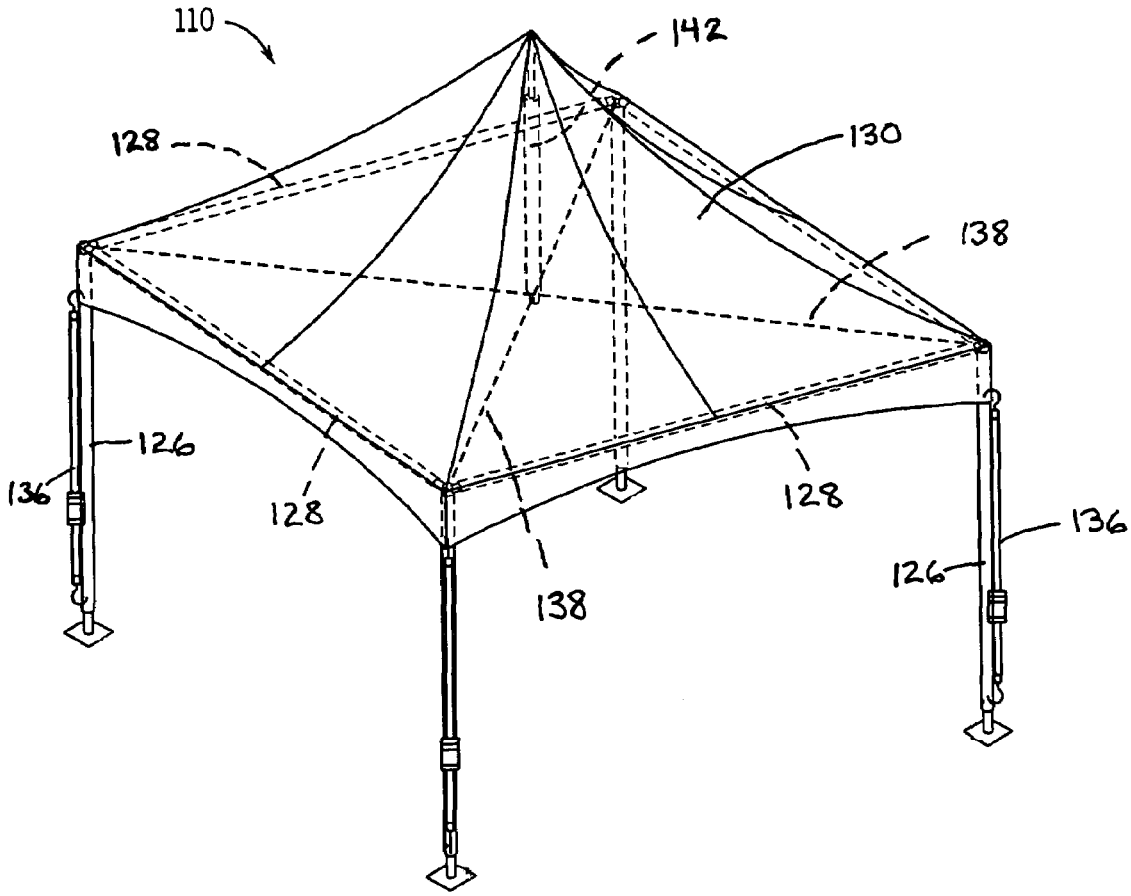
FIG. 1 PRIOR ART
FIG. 1 is a perspective view of a conventionally known tent.

Before explaining a number of preferred, exemplary, and alternative embodiments of the invention in detail it is to be understood that the invention is not limited to the details of construction and the arrangement of the components set forth in the following description or illustrated in the drawings. The invention is capable of other embodiments or being practiced or carried out in various ways. It is also to be understood that the phraseology and terminology employed herein is for the purpose of description and should not be regarded as limiting.

DETAILED DESCRIPTION OF PREFERRED AND OTHER EXEMPLARY EMBODIMENTS

Before proceeding to the detailed description of the preferred and exemplary embodiments, several comments can be made about the general applicability and the scope thereof.

For example, while the components of the disclosed embodiments will be illustrated as a canopy tension adjuster designed for a tent, the features of the disclosed embodiments have a much wider applicability. For example, the canopy tension adjuster design is adaptable for other portable shelters, canopies, tents, awnings, marquees, pavilions, and other commercial or recreational products with a covering material held in tension. Further, the size of the various components and the size of the containers can be widely varied.

Also, the particular materials used to construct the exemplary embodiments are also illustrative. For example, components of the canopy tension adjuster can also be manufactured from stamped alloy materials such as steel or aluminum, but other materials can be used, including other thermoplastic resins such as injection molded high density polyethylene, polypropylene, other polyethylenes, acrylonitrile butadiene styrene ("ABS"), polyurethane nylon, any of a variety of homopolymer plastics, copolymer plastics, plastics with special additives, filled plastics, etc. Also, other fabricating, stamping, or molding operations may be used to form these components.

Further, it is important to note that the terms "tent," "brackets," "frame," and "cover" or "covering" are intended to be broad terms and not terms of limitation. These components may be used with any of a variety of products or arrangements and are not intended to be limited to use with canopy or tent applications.

Figure 3:
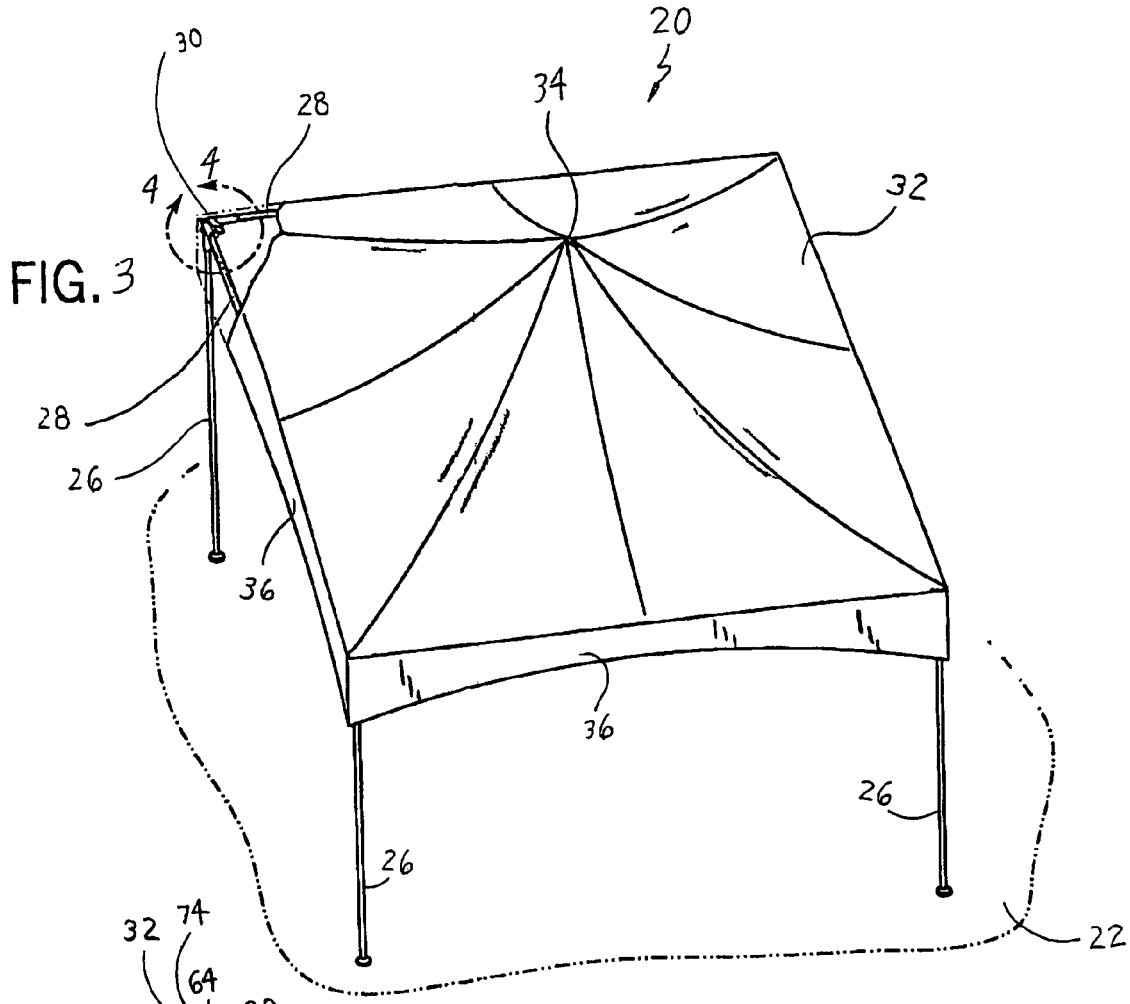
FIG. 3 is a fragmentary perspective view of a tent including an exemplary embodiment of a canopy tension adjuster of the present invention.
Figure 4:
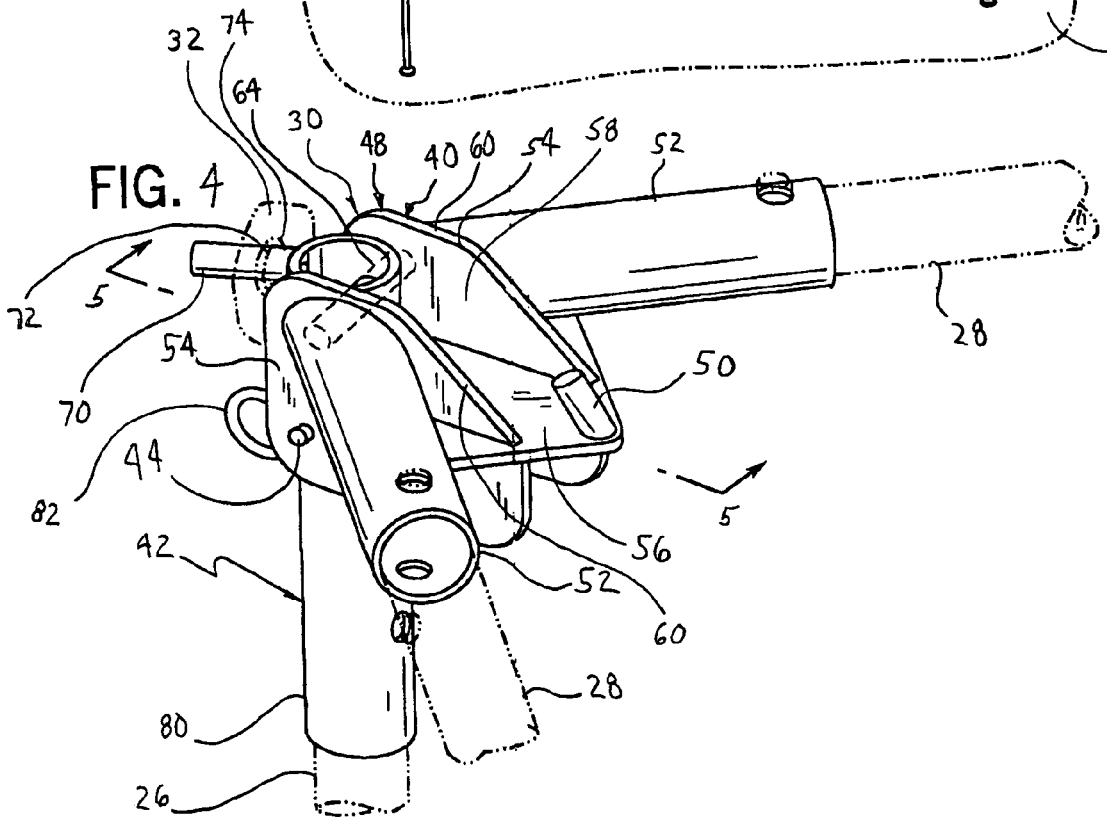
FIG. 4 is an enlarged perspective view of the canopy tension adjuster of FIG. 1 taken along line 4—4 illustrating the adjuster in a tensioned position.

Proceeding now to descriptions of the preferred and exemplary embodiments, FIGS. 3–8 show portable shelter or tent 20 according to an exemplary embodiment. FIG. 3 illustrates tent 20 in a fully assembled and erected state upon a foundation or ground surface 22. Tent 20 generally includes support poles 26, cross poles 28, a center support assembly, canopy 32 and tension adjusters 30. Support poles 26 comprise generally elongate rigid tubes, shafts or other structures configured to elevate cross poles 28 and canopy 32 above ground 22. Support poles 26 are preferably configured to extend substantially perpendicular to the ground 22 when tent 20 is erected. Support poles 26 preferably elevate cross poles 28 to a height above ground 22 sufficient so as to permit a person of average height to walk beneath cross poles 28 without genuflecting. For ease of storage and assembly, support poles 26 may be collapsible either by folding action or by telescopic reduction. Although tent 20 preferably includes four such cross poles located at each corner of tent 20, tent 20 may alternatively include a greater or fewer number of such cross poles depending upon the desired overall configuration of tent 20.

Cross poles 28 comprise elongate rigid structures extending between support poles 26. Cross poles 28 support the perimeter of canopy 32 between support poles 26. When connected to one another, cross poles 28 extend along axes which are perpendicular to one another. When connected to support poles 26, cross poles 28 all lie in a common plane which extends perpendicular to support poles 26. When assembled, cross poles 28 preferably extend in a substantially horizontal plane substantially parallel to ground 22. In the exemplary embodiment illustrated, cross poles 28 are coupled to support poles 26 by canopy tension adjusters 30 at each of the corners of tent 20. Alternatively, cross poles 28 may be directly coupled to support poles 26 by connectors distinct from adjusters 30. Cross poles 28 may also alternatively be integrally formed or permanently affixed directly or indirectly to support poles 26. In the exemplary embodiment, tent 20 includes four such cross poles 28 to provide tent 20 with its generally rectangular shape. Alternatively, tent 20 may be provided with greater or fewer number of cross poles 28 depending upon the overall desired configuration of tent 20. Moreover, although each cross pole 28 preferably comprises a single elongate pole or bar, cross poles 28 may include multiple sections or a frame work of multiple sections or segments extending parallel or oblique to one another. Cross pole 28 may further be configured to be collapsible either by folding action or by telescopic reduction or extension.

Figure 2:
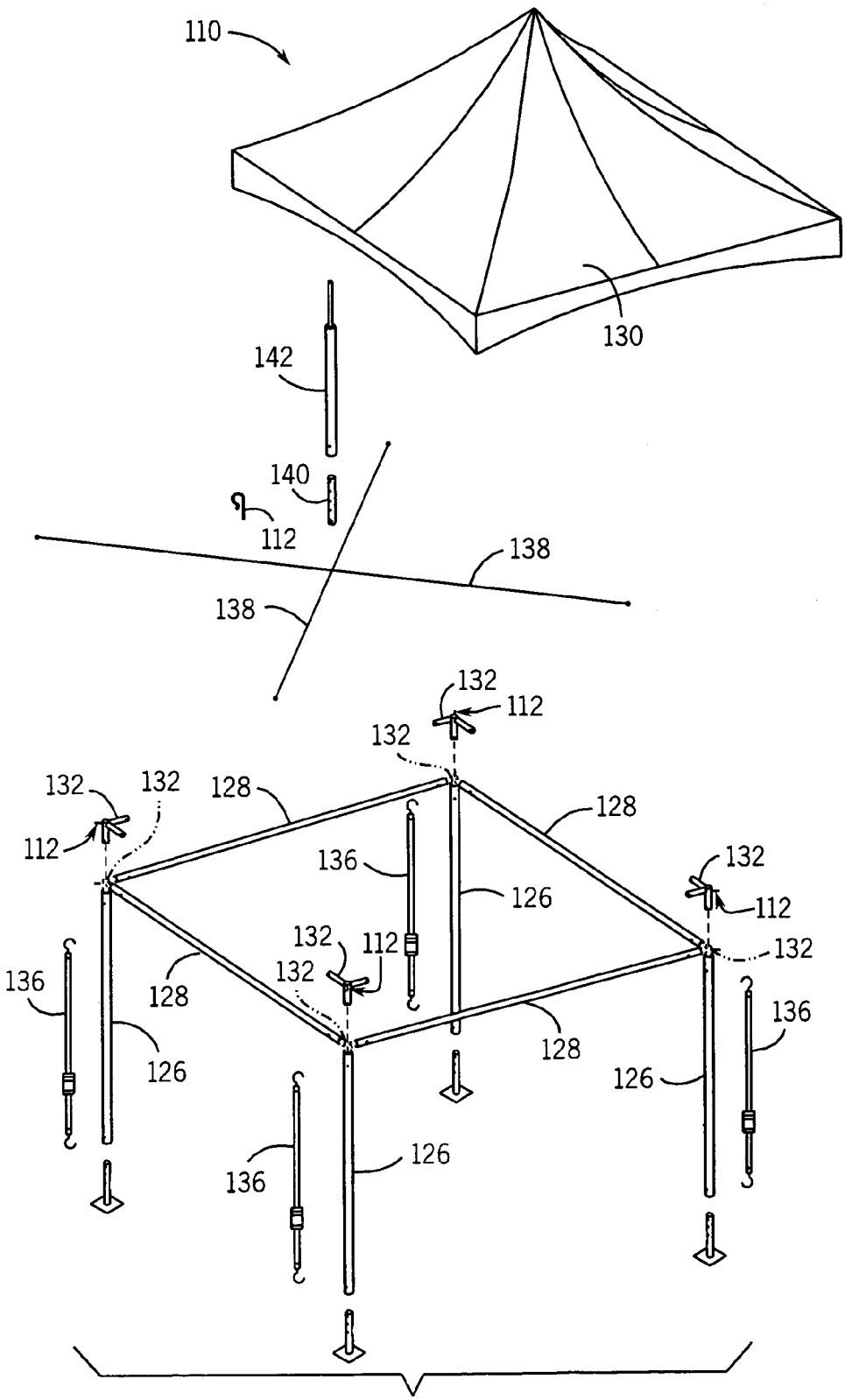
FIG. 2 PRIOR ART
FIG. 2 is an exploded perspective view of the tent of FIG. 1 with selected components, such as corner brackets and cables, shown again in an assembled state.

The center support assembly of tent 20 is substantially identical to the center support assembly of portable shelter 10 shown in FIGS. 1 and 2 which includes cables 138, poke-up rod 142, and pulley bar 140. As utilized with tent 20, cables 138 crisscross one another and extend between tension adjusters 30 and support pulley bar 140 and poke-up rod 142 at a central location between cross poles 28. Poke-up rod 142 further elevates a peak 34 of canopy 32 in a known fashion.

Although tent 20 preferably includes cables 138, pulley bar 140 and poke-up rod 142, tent 20 may alternatively include various other center support assemblies configured to elevate portions of canopy 32 to provide canopy 32 with an inclined gradient for rain runoff and for aesthetic reasons. For example, tent 20 may alternatively include a center support structure which is configured to elevate multiple points of canopy 32 to provide canopy 32 with a plurality of spaced peaks. Tent 20 may also be provided with a center support assembly which is configured to elevate canopy 32 along one or more continuous elongate peaks extending from one cross pole 28 to an opposite cross pole 28. Moreover, in lieu of including cables 138 and a poke-up rod 142, the center support assembly of tent 20 may comprise rigid poles or other support structures that span the opening between cross poles 28 or between support poles 26. Such rigid structures may be collapsible by means of folding, accordion-like arrangements or by means of telescopic segments. In alternative embodiments, tent 20 may omit a center support assembly such that canopy 32 extends in a generally flat plane across or between cross poles 28.

Canopy 32 comprises an elongate sheet or connected sections of flexible material. In the exemplary embodiment, canopy 32 is formed from canvas. Canopy 32 is configured to be suspended by the remaining components of tent 20 at a height above ground 22. Although canopy 32 is illustrated as having a single peak, canopy 32 may be provided with a plurality of peaks or an elongate peak. Although canopy 32 is illustrated as including a side portion 36 which extends in a vertical direction towards ground 22 and which is spaced well above ground 22, canopy 32 may omit such side portion 36 or may include a side portion 36 which extends substantially to ground 22 on one or more sides of tent 20. In such an alternative embodiment, at least one of side portions 36 may additionally include a door or other opening for access to the interior of tent 20. The exact configuration of canopy 32 may be varied depending upon the overall desired configuration of tent 20.

Canopy tension adjusters 30 are generally located at each location on tent 20 where canopy 32 is preferably stretched and placed in tension. In the particular embodiment illustrated, adjusters 30 are located at each corner of tent 20 at the junction of cross poles 28 and support poles 26.

One of adjusters 30 is illustrated in greater detail in FIGS. 4–7. Adjuster 30 generally includes connector structure or portion 40, swivel portion 42 and locking mechanism 44. Connector portion 40 comprises a structure configured to be releasably coupled to cross poles 28. In the exemplary embodiment, connector portion 40 is configured to releasably connect cross poles 28 such that cross poles 28 extend along perpendicular axes. Connector portion 40 is further configured to be connected to cables 138 or other components of the center support assembly of tent 20. In the particular embodiment illustrated, connector portion 40 generally includes base 48, cable mount 50 and cross pole mounts 52. Base 48 comprises a rigid structure from which the remaining portions of adjuster 30 extend. Base 48 generally comprises a pair of rigid plates 54 joined to one another by an intermediate plate 56. Intermediate plate 56 is preferably firmly joined to plates 54 by welding. Alternatively, plate 56 is secured to plates 54 by other fastening methods and mechanisms. Moreover, in alternative embodiments, plates 54 and 56 are integrally formed as a single unitary structure. In addition, other structures may be employed to provide base 48 in lieu of plate 54 and plate 56. Plates 54 form a channel 58 which facilitates pivotal movement of swivel portion 42. At the same time, plates 54 provide upwardly facing edges 60 against which canopy 32 may be pulled into a taut or tensioned state over cross pole mounts 52 and substantially over swivel portion 42.

Cable mount 50 is coupled to base 48 and is configured to be coupled to ends of cable 138 (shown in FIG. 2). In the exemplary embodiment, cable mount 50 comprises a pin fixedly coupled to plate 56. Alternatively, other mounting mechanisms may be secured to plate 56 or to other stationary parts of base 48 and/or connector portion 40 for retaining an end of cable 138. In other embodiments where tent 20 is provided with alternative center support assemblies, either base 48 and/or connector portion 40 may be configured so as to be releasably or permanently coupled to the components of the center support assembly, whether such components comprise a cable or other flexible member or whether such components include a rigid structure such as a pole or the like.

Cross pole mounts 52 are coupled to base 48 and are configured to secure cross poles 28 to base 48. In an exemplary embodiment, cross pole mounts 52 comprise tubes or shafts which are fixedly coupled to base 48 and which are configured to receive cross poles 28 which are pinned to mounts 52. Alternatively, cross pole mounts 52 may comprise tubes which are configured to be received within bores of cross poles 28 which are pinned to mounts 52. Although cross pole mounts 52 are preferably welded to base 48, cross pole mounts 52 may be integrally formed as part of a single unitary body with base 48 or may be secured to base 48 by various other fastening or joining methods. Moreover, depending upon the configuration of cross poles 28, cross pole mounts 52 may have any of a variety of alternative shapes, sizes and configurations so as to be releasably joined to cross poles 28. Although less desirable, base 48 and cross pole mounts 52 may alternatively be fixedly coupled to or integrally formed as part of a single unitary body with a single cross pole 28 or a pair of cross poles 28.

Figure 7:
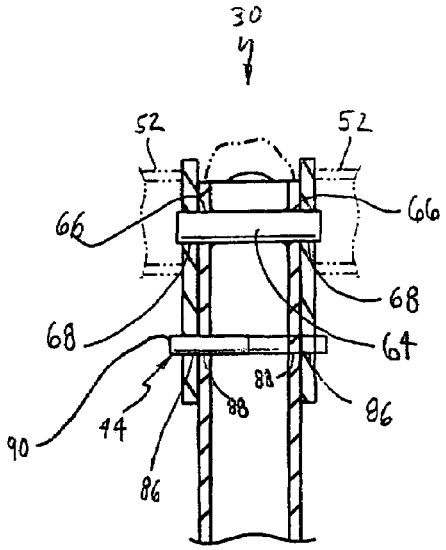
FIG. 7 is a sectional view of the canopy tension adjuster of FIG. 6 taken along line 7—7.

Swivel portion 42 comprises a rigid structure coupled to canopy 32 and pivotally coupled to connector portion 40. Swivel portion 42 pivots relative to connector portion 40 between a relaxed position in which canopy 32 is in a relaxed state (best shown in FIG. 5) and a tensioned position in which the canopy is in a taut or tensioned state (best shown in FIG. 6). Swivel portion 42 is pivotally coupled to connector portion 40 by means of pin 64 and a pair of aligned openings 66 extending through swivel portion 42 (as best shown by FIG. 7). In the exemplary embodiment, pin 64 has ends which project into a pair of aligned bores 68 formed in plates 54. The ends of pins 64 are preferably fixed to plate 54 such that swivel portion 42 rotates relative to pin 64. Alternatively, swivel portion 42 may be fixed to pin 64 wherein the ends of pin 64 rotate within bores 68. Swivel portion 42 may be pivotally coupled to connector portion 40 by various other conventionally known and future developed pivoting support mechanisms and methods.

Figure 5:
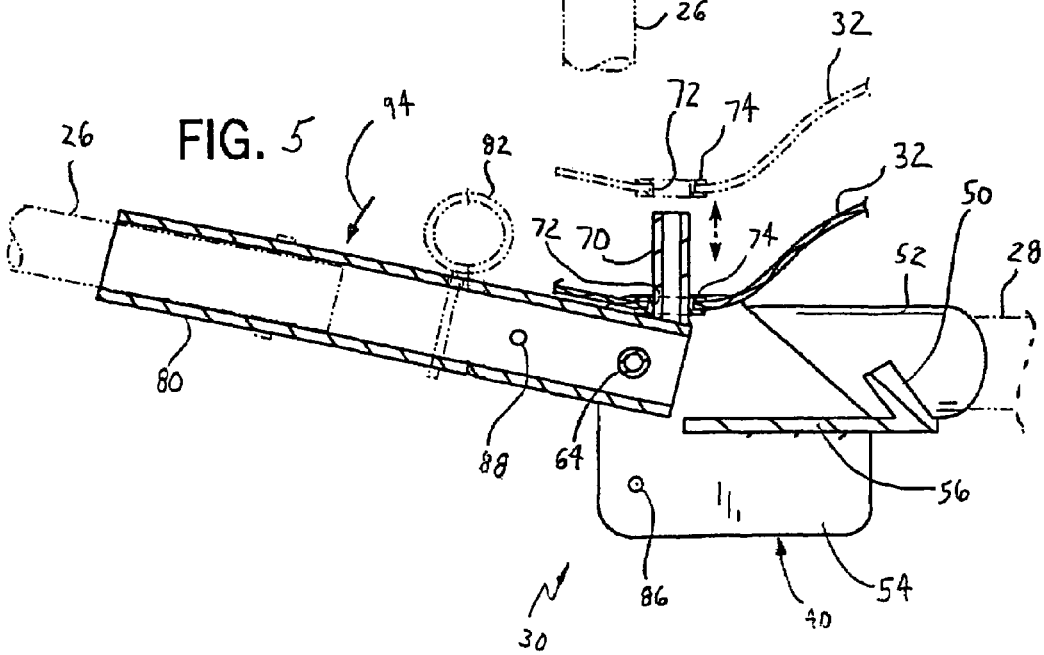
FIG. 5 is a sectional view of the canopy tension adjuster of FIG. 4 taken along line 5—5 illustrating the tension adjuster in a relaxed position.

As best shown by FIG. 5, swivel portion 42 is preferably releasably coupled to canopy 32. In the particular embodiment illustrated, swivel portion 42 includes a hook, pin or post 70 configured to project through an opening 72 formed within canopy 32 so as to engage and interconnect swivel portion 42 and canopy 32. In the preferred embodiment, opening 72 is bound by a grommet 74. In alternative embodiments, canopy 32 may be releasably coupled to swivel portion 42 by various other fastening devices. For example, canopy 32 may be provided with a hook configured to engage an opening formed as part of swivel portion 42. Swivel portion 42 or canopy 32 may alternatively be provided with a clamping device, a snap, or other structures for releasably securing canopy 32 to swivel portion 42. Although less desirable, canopy 32 and swivel portion 42 may alternatively be permanently affixed, bonded or joined to one another.

Figure 8:
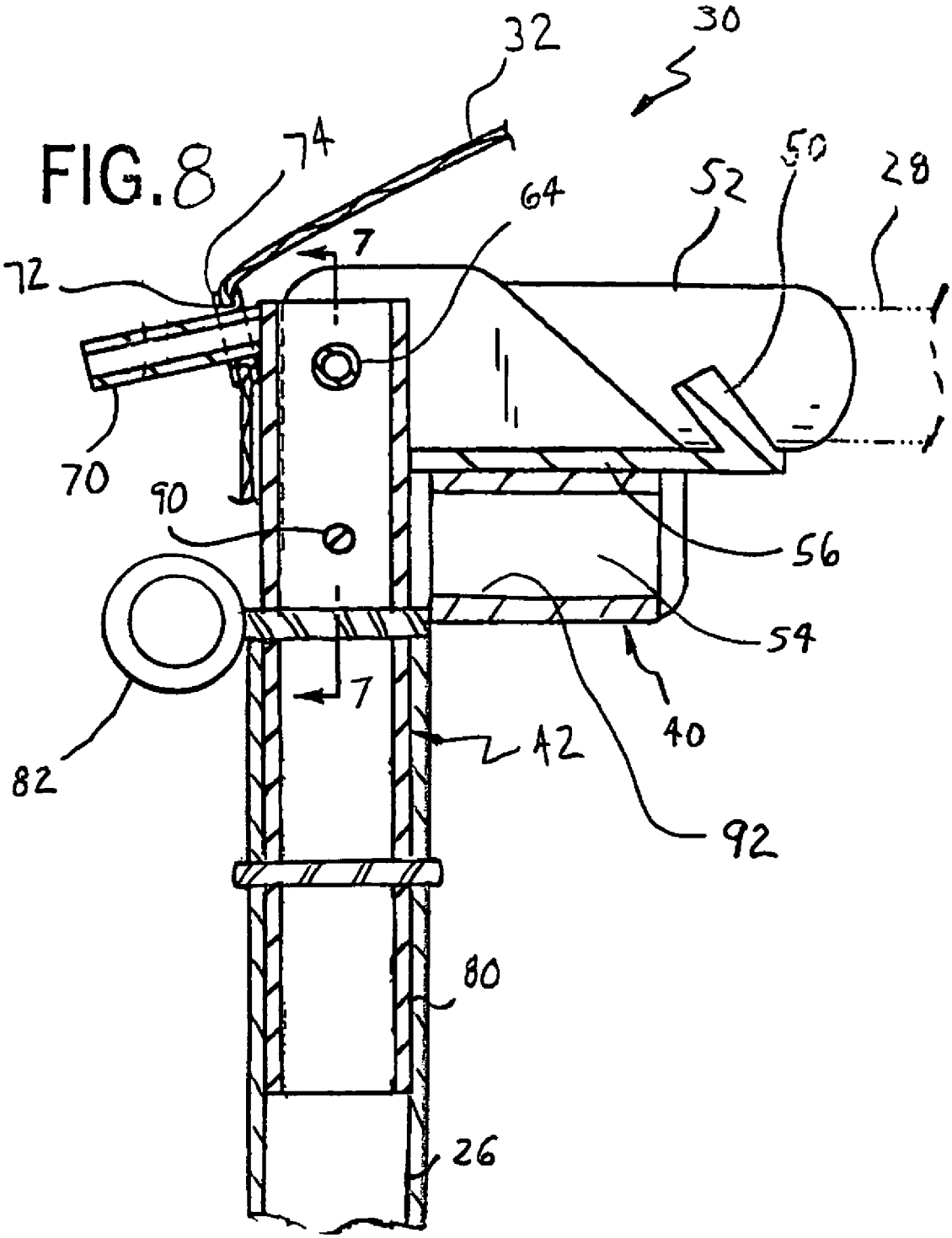
FIG. 8 is a sectional view of the canopy tension adjuster according to an exemplary embodiment.

Swivel portion 42 additionally includes support pole mounting portion 80 and anchor 82. Support pole mounting portion 80 extends at a lower end of swivel portion 42 and is configured to be releasably coupled to one of support poles 26. As a result, each adjuster 30 releasably connects cross poles 28, support poles 26 and the center support assembly. In the embodiment illustrated, support pole mounting portion 80 comprises a tubular structure configured to removably receive a portion of support pole 26 such that support pole 26 may be pinned or otherwise fastened to swivel portion 42. Alternatively, as shown in FIG. 8, support pole mounting portion 80 may be configured to be received within an internal bore formed in one of support poles 26. In alternative embodiments, support pole mounting portion 80 may be permanently attached to or integrally formed as part of support poles 26.

Anchor 82 comprises a structure coupled to swivel portion 42 and is configured to be releasably affixed to a rope, cable or other structure extending to ground 22 and staked or otherwise fastened to ground 22 to further anchor support pole 26. In the exemplary embodiment, anchor 82 comprises an eye bolt affixed to swivel portion 42. Alternatively, other anchor structures may be provided upon swivel portion 42. As shown in FIG. 8, anchor 82 may be configured (e.g., positioned) to restrict the upward movement of support pole 26 after support pole 26 is releasably coupled to support pole mounting portion 80. Anchor 82 abuts the end of support pole 26, thereby allowing swivel portion 42 to be positioned along support pole 26 according to a desired configuration. Anchor 82 may be coupled to swivel portion 42 by various fastening or joining methods (e.g., threading, welding, etc.). Alternatively, anchor 82 may be integrally formed as part of a single unitary body with swivel portion 42. Moreover, in alternative embodiments, anchor 82 may be omitted.

Locking mechanism 44 comprises a mechanism configured to releasably retain swivel portion 42 in the tensioned position. As best shown by FIG. 7, locking mechanism 44 generally includes a pair of aligned bores 86 extending through connector portion 40, a pair of aligned bores 88 extending through swivel portion 42 and a locking pin 90. When swivel portion 42 is positioned in the tensioned position, bores 86 and 88 are aligned such that pin 90 may be inserted through bores 86 and 88 to retain swivel portion 42 relative to connector portion 40. Alternatively, various other conventionally known and future developed locking methods and mechanisms may be employed to releasably retain swivel portion 42 in the tensioned position. For example, locking pin 90, locking mechanism 44 may employ an eye bolt or other member. Locking mechanism 44 may include catches, releasable interlocking members, straps, clips or a variety of other mechanisms configured to releasably retain one component relative to another component.

Figure 6:
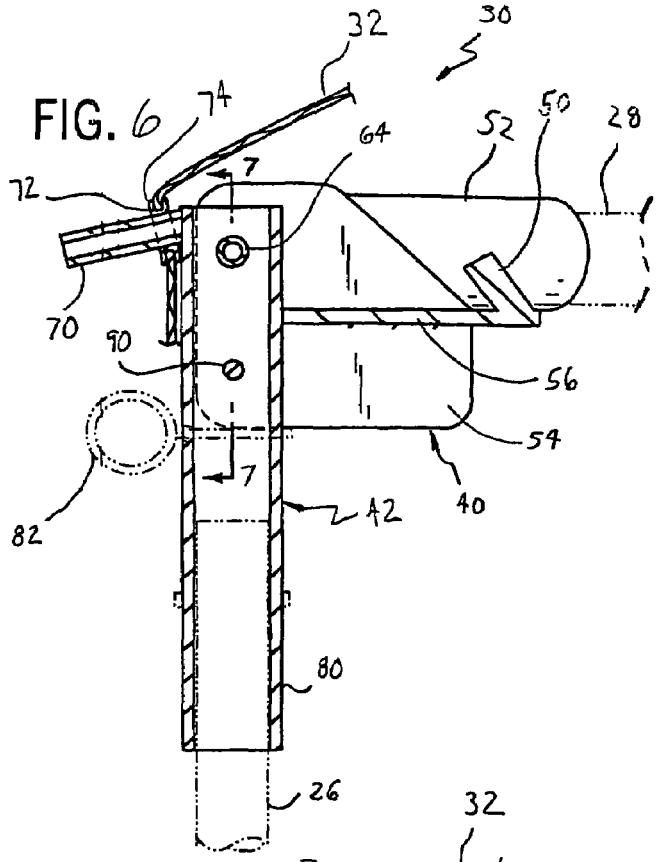
FIG. 6 is a sectional view of the canopy tension adjuster of FIG. 4 taken along line 5—5 illustrating the adjuster in the tensioned position.

FIGS. 5 and 6 illustrate the swiveling of swivel portion 42 in greater detail. FIG. 5 illustrates swivel portion 42 pivoted to a substantially horizontal position in which canopy mount 70 is more closely located toward the center of canopy 32. As a result, opening 72 may be more easily mounted to mount 70 while in a relaxed state as shown. Once canopy 32 is mounted to mount 70, swivel portion 42 is thereafter pivoted in a counterclockwise direction as indicated by arrow 94 until swivel portion 42 is in a substantially vertical setup position. When in the setup position shown in FIG. 6, canopy 32 is in tension. To maintain swivel portion 42 in the setup tensioned position, pin 90 is inserted through aligned bores 86 and 88 to prevent further relative movement between swivel portion 42 and connector portion 40. Conversely, to remove canopy 32, the operation is simply performed in reverse order. During assembly, the actuation or swiveling of swivel portion 42 may be performed while one or more of support poles 26 are coupled to adjusters 30 or left uncoupled from adjusters 30.

According to a preferred embodiment, canopy tension adjuster 30 comprises square tubes (or channels) 92. Tubes 92 may be configured to abut anchor 82 when swivel portion 42 is in the tensioned position, thereby preventing swivel portion 42 from swiveling beyond a desired configuration. As shown in FIG. 8, tubes 92 are coupled to plates 54 and plates 56. In the particular embodiment illustrated, tubes 92 are fixedly attached (e.g., welded) to plates 54 and plates 56. Alternatively, tubes 92 may be coupled to plates 54 and plates 56 by various fastening or joining methods (e.g., fastening, clamping, hooking, sliding, etc.). Alternatively, tubes 92 may be integrally formed as part of a single unitary body with plates 54 and plates 56. Moreover, in alternative embodiments, tubes 92 may be omitted.

In the particular embodiment illustrated, canopy tension adjusters 30 perform multiple functions. First, adjusters 30 interconnect cross poles 28 and support poles 26 to one another. In addition, adjusters 30 further interconnect cross poles 28 and support poles 26 to the center support assembly. Second, adjusters 30 provide a connection point for cables, ropes or other tie down mechanisms for further anchoring support poles 26. Most importantly, adjusters 30 enable the tension of canopy 32 to be adjusted and placed in a taut, tensioned state. Alternatively, adjusters 30 may be modified to simply perform the function of canopy tension adjustment without one or more of the additional features. For example, adjuster 30 may be configured such that adjuster 30 releasably mounts to an existing frame wherein tent frame components such as support poles 26 and cross poles 28 are connected to one another by an independent connecting structure or are integrally formed or permanently affixed to one another independent of adjuster 30. According to one exemplary embodiment, adjuster 30 includes a stationary portion which is clamped or otherwise secured to an existing junction between cross poles 28 and a swivel portion pivotally coupled to the stationary portion, wherein the swivel portion is configured to be releasably coupled to the canopy and to pivot between the relaxed position and the tensioned position. Depending upon the exact configuration of the tent, such an adjuster 30 may be mounted to the frame of a tent at any of a variety of locations where the canopy needs to be tensioned. In yet other embodiments, the stationary portion may be welded, permanently affixed or integrally formed as part of one or more of the tent frame components, wherein the swivel portion is pivotally coupled to the stationary portion and pivots between the tensioned and relaxed positions. Such tent frame components to which adjuster 30 may be coupled include cross poles 28, support poles 26 and any component of the center support assembly. Although each adjuster 30 is preferably formed from a rigid material such as metal, adjusters 30 may be formed from other materials such as plastic, wood and the like wherein such materials have a sufficient strength to withstand the encountered forces.

Overall, adjusters 30 enable a canopy, such as canopy 32, to be quickly and easily connected to an underlying frame and to be placed in a taut or tensioned state. Adjusters 30 facilitate such set up without the need for special pry bar tools or large setup crews. As a result, such portable shelters and tents may be manufactured, set up and taken down at a lower cost.

It is also important to note that the construction and arrangement of the elements of the canopy tension adjuster as shown in the preferred and other exemplary embodiments are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, components of the canopy tension adjuster may be manufactured from stamped alloy materials such as steel or aluminum, but other materials may also be used, including other thermoplastic resins such as injection molded high density polyethylene, polypropylene, other polyethylenes, acrylonitrile butadiene styrene ("ABS"), polyurethane nylon, any of a variety of homopolymer plastics, copolymer plastics, plastics with special additives, filled plastics, etc. Also, other fabricating, stamping, or molding operations may be used to form these components. Further, although different preferred embodiments may have been described as including one or more features providing one or more benefits, it is contemplated that the described features may be interchanged with one another or alternatively be combined with one another in the described preferred embodiments or in other alternative embodiments. Because the technology of the present invention is relatively complex, not all changes in the technology are foreseeable. Further, unless specifically otherwise noted, the claims reciting a single particular element also encompass a plurality of such particular elements. Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A tension mechanism for use with a frame and covering, the tension mechanism comprising:

a first portion configured to be fixably coupled to the frame;

a second portion pivotally coupled to the first portion and configured to be coupled to the covering such that the covering is in a relaxed state when the second portion is in a first, unlocked position and such that the covering is in a tensioned state when the second portion is in a second, locked position;

wherein the second portion creates the tensioned state in the covering by pivoting movement relative to the first portion from the first, unlocked position to the second, locked position while maintaining the first portion fixed relative to the frame;

wherein the second portion comprises a projection configured to engage the covering;

wherein the projection extends generally upwardly when the second portion is in the first position; and wherein the projection extends generally downwardly when the second portion is in the second position.

2. The tension mechanism of claim 1 further comprising a lock configured to retain the second portion in the second position.

3. A tension mechanism for use with a frame and covering, the tension mechanism comprising:

a first portion configured to be coupled to the frame; and a second portion pivotally coupled to the first portion and configured to be coupled to the covering such that the covering is in a relaxed state when the second portion is in a first, unlocked position and such that the covering is in a tensioned state when the second portion is in a second, locked position;

a lock configured to retain the second portion in the second position;

wherein the second portion creates the tensioned state in the covering by pivoting movement relative to the first portion from the first, unlocked position to the second, locked position; and wherein the lock comprises a pin that engages aligned bores in the first portion and the second portion when the second portion is in the second position.

4. The tension mechanism of claim 3 wherein the first portion is a stationary bracket relative to the frame and the second portion is a swiveling bracket that may be coupled to the covering and may be pivoted relative to the stationary bracket.

5. A tent comprising:

a covering;

a frame configured to support the covering;

a tension mechanism including:

a first portion fixably coupled to the frame; and a second portion pivotally coupled to the first portion and having a projection configured to engage the covering;

wherein pivoting movement of the second portion of the tension mechanism from a first, unlocked position to a second, locked position, while maintaining the first portion fixed relative to the frame, creates a tensioned state in the covering that is coupled to the projection of the second portion.

6. The tent of claim 5 wherein the projection extends generally upwardly when in the first position.

7. The tent of claim 6 wherein the projection extends generally downwardly when the second portion is in the second position.

8. The tent of claim 7 wherein the covering is removable from the projection when the second portion is in the first position.

9. The tent of claim 5 wherein the covering includes an opening that receives the projection extending from the second portion.

10. The tent of claim 9 wherein the opening is defined by a grommet coupled to the covering.

11. A tent comprising:

a covering;

a frame configured to support the covering;

a tension mechanism including:

a first portion fixably coupled to the frame; and a second portion pivotally coupled to the first portion and having a projection configured to engage the covering;

wherein pivoting movement of the second portion of the tension mechanism from a first position to a second position, while maintaining the first portion fixed relative to the frame, creates a tensioned state in the covering that is coupled to the projection of the second portion; and wherein the frame comprises a support pole coupled to the second portion and wherein the projection extends at an acute angle relative to the support pole.

12. The tent of claim 11 wherein the support pole is disposed in a generally vertical orientation when the second portion is in the second position.

13. A tent comprising:

a covering;

a frame configured to support the covering;

a tension mechanism including:

a first portion coupled to the frame; and a second portion pivotally coupled to the first portion and having a projection configured to engage the covering;

wherein pivoting movement of the second portion of the tension mechanism from a first position to a second position creates a tensioned state in the covering that is coupled to the projection of the second portion;

wherein the frame comprises a support pole coupled to the second portion wherein the projection extends at an acute angle relative to the support pole;

wherein the support pole is disposed in a generally vertical orientation when the second portion is in the second position; and wherein the frame comprises a generally horizontal first cross pole and a generally horizontal second cross pole, and wherein the first portion couples the first cross pole to the second cross pole.

14. The tent of claim 13 wherein the first cross pole, the second cross pole, and the support pole extend generally perpendicular to each other.

15. The tent of claim 13 further comprising a lock releasably retaining the second portion in the second position.

16. The tent of claim 15 wherein the lock comprises a pin that engages a bore in the first portion and a bore in the second portion, the bore in the first portion and the bore in the second portion being aligned when the second portion is in the second position.

17. A method for erecting a tent comprising the steps of:

providing a frame, a covering, and a tension mechanism coupled to the frame and having a first portion pivotable between a first, unlocked position and a second, locked position and further having a second portion;

coupling the covering to the first portion when the first portion is in the first, unlocked position;

applying tension to the covering by pivoting the first portion from the first, unlocked position to the second, locked position while maintaining the second portion fixed relative to the frame.

18. The method of claim 17 wherein the step of coupling the covering to the first portion comprises coupling the covering to a projection extending from the first portion.

19. The method of claim 18 wherein the projection pivots from a generally upward orientation to a generally downward orientation when the first portion is pivoted from the first position to the second position.

20. The method of claim 19 wherein the step of coupling the covering to the projection comprises inserting the projection into an opening on the covering.

21. The method of claim 20 wherein the projection is inserted into the opening when the projection is in the generally upward orientation.

22. The method of claim 17 wherein the step of pivoting the first portion comprises pivoting the projection form a generally upward orientation to a generally downward orientation.

23. A method for erecting a tent comprising the steps of:

providing a frame, a covering, and a tension mechanism coupled to the frame and having a first portion pivotable between a first position and a second position and a second portion fixably coupled to the frame;

coupling the covering to the first portion when the first portion is in the first position;

applying tension to the covering by pivoting the first portion from the first position to the second position while maintaining the second portion fixed relative to the frame; and wherein the step of providing the frame comprises the step of providing a support pole coupled to the first portion and disposed in a generally vertical orientation when the first portion is in the second position.

24. The method of claim 23 wherein the step of providing the frame further comprises the step of providing the support pole that is disposed in a generally horizontal orientation when the first portion is in the first position.

* * * * *